US006997828B1

(12) United States Patent
Yang

(10) Patent No.: US 6,997,828 B1
(45) Date of Patent: Feb. 14, 2006

(54) BOOMERANG

(76) Inventor: Ming-Tang Yang, Han-Kuo South 2nd St., North Dis., Taichung (TW) 404

( * ) Notice: Subject to any disclaimer, the term of this patent is extended or adjusted under 35 U.S.C. 154(b) by 0 days.

(21) Appl. No.: 10/930,762

(22) Filed: Sep. 1, 2004

(51) Int. Cl.
*A63B 65/10* (2006.01)

(52) U.S. Cl. ..... 473/590

(58) Field of Classification Search ..... 473/589, 473/590; 446/46, 48
See application file for complete search history.

(56) References Cited

U.S. PATENT DOCUMENTS 862,094 A * 7/1907 Morton ..... 473/590
5,259,802 A * 11/1993 Yang ..... 446/48
5,816,879 A * 10/1998 Kyame ..... 446/48

* cited by examiner

*Primary Examiner*—Steven Wong
(74) *Attorney, Agent, or Firm*—Bacon & Thomas, PLLC

(57) ABSTRACT

A boomerang includes a central disk comprised of concentric inner and outer rings that are connected by radially extending connection sections. Wings radially extend from an outer circumference of the outer ring, corresponding in position to the connection sections. The inner ring defines a central bore. Arc openings are formed between the inner and outer rings and delimited by the connection sections. Aligned openings are defined in each wing and the associated connection section. Tabs extend from edges of the openings in opposite directions and also incline in opposite directions. Further tabs are formed on and extend from an inner circumference of the outer ring. When the boomerang flies, the central bore, the arc openings, and other openings allow airflow to pass therethrough, while the tabs impose constraints to the airflow to induce stable and extended flying of the boomerang in the air.

10 Claims, 6 Drawing Sheets

BOOMERANG

BACKGROUND OF THE INVENTION

1. Field of the Invention

The present invention relates generally to a boomerang, and in particular to a boomerang structure having airflow holes to facilitate smooth and stable flying and comprising inclined tabs extending in opposite directions to enhance buoyancy of the boomerang in the air.

2. The Related Art

A conventional boomerang comprises a V-shaped or trifurcate configuration. Such designs often cause instability of boomerang flying in the air, leading to undesired falling of the boomerang, especially when the flying boomerang encounters turbulences or blows. As a consequence, losing the boomerang is one of the major concerns of the boomerang players, which makes unpleasant experience of playing boomerang.

Taiwan Patent Application No. 91215848, filed by the present inventor, discloses a boomerang that allows for stable flying and enhanced floatation of the boomerang in the air. FIG. 1 of the attached drawings shows such a conventional boomerang. However, flying stability and floating cycle of the boomerang can be further improved and the present invention is aimed to further improve the boomerang structure in order to enhance flying stability and extend floating cycle of the boomerang.

SUMMARY OF THE INVENTION

An object of the present invention is to provide a boomerang featuring enhanced flying stability and extended flying time.

Another object of the present invention is to provide a boomerang comprising a central disk from which wings radially extend, wherein airflow holes are defined in the central disk and the wings to allow airflow to pass therethrough for facilitating flying stability of the boomerang.

A further object of the present invention is to provide a boomerang comprising a central disk from which wings radially extend, wherein tabs that extend in opposite directions with an angle with respect to the central disk are formed for facilitating floatation of the boomerang and thus extending flying time.

To achieve the above objects, in accordance with the present invention, there is provided a boomerang comprising a central disk comprised of concentric inner and outer rings that are connected by radially extending connection sections. Wings radially extend from an outer circumference of the outer ring, corresponding in position to the connection sections. The inner ring defines a central bore. Arc openings are formed between the inner and outer rings and delimited by the connection sections. Aligned openings are defined in each wing and the associated connection section. Tabs extend from edges of the openings in opposite directions and also incline in opposite directions. Further tabs are formed on and extend from an inner circumference of the outer ring. When the boomerang flies, the central bore, the arc openings, and other openings allow airflow to pass therethrough, while the tabs impose constraints to the airflow to induce stable and extended flying of the boomerang in the air.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
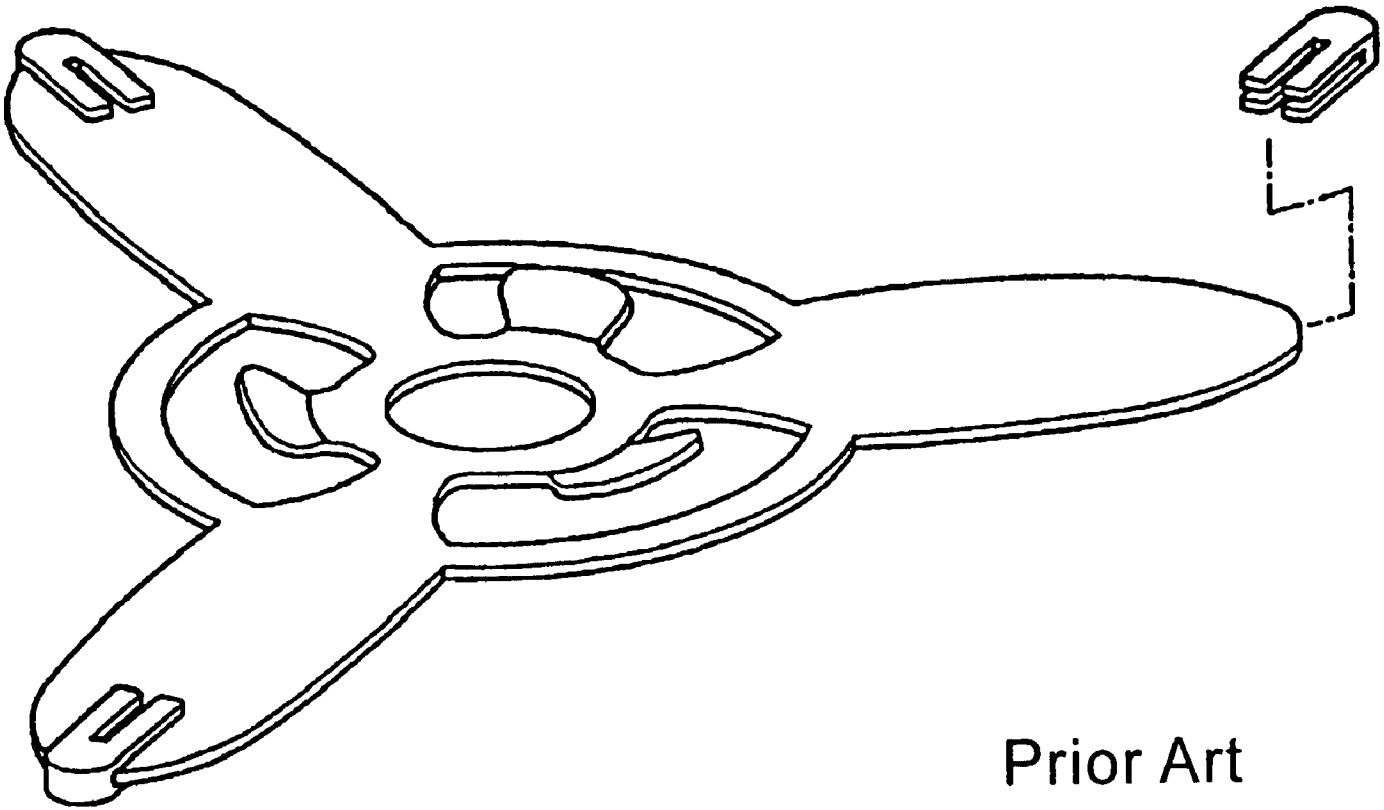
Prior Art FIG 1
FIG. 1 is a perspective view of a conventional boomerang.
Figure 2:
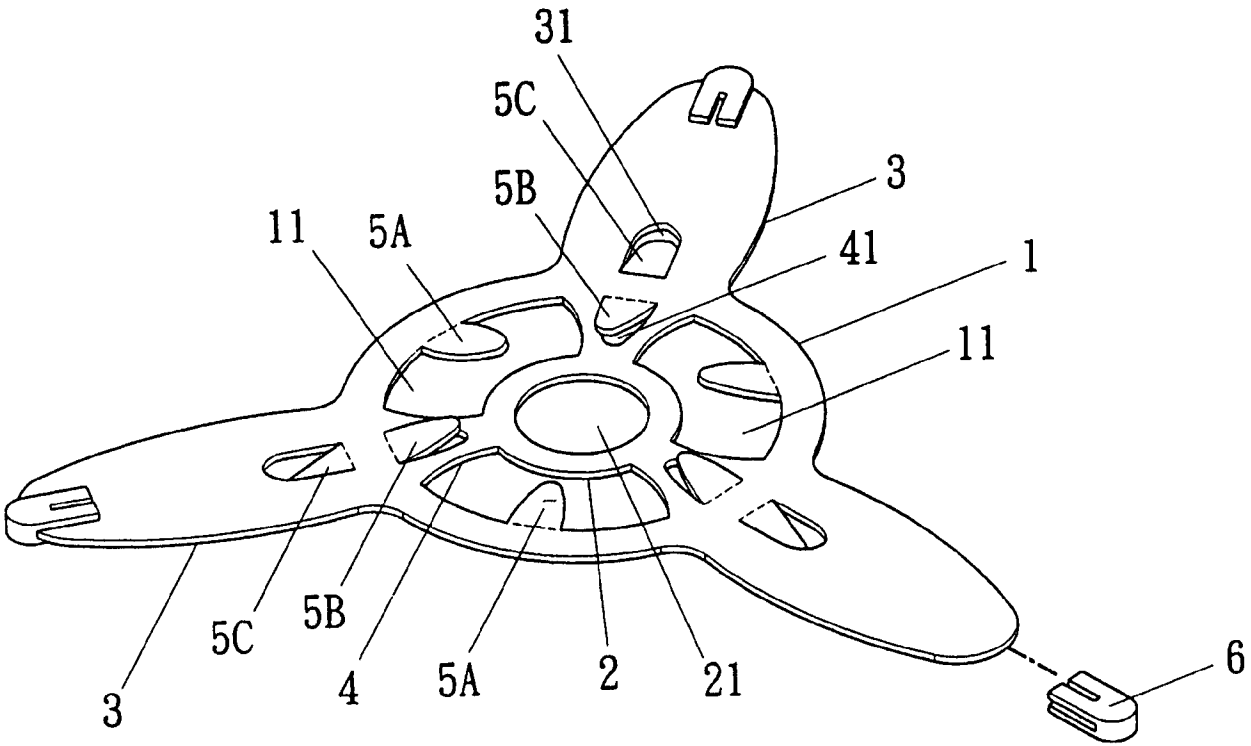
FIG. 2 is a perspective view of a boomerang constructed in accordance with the present invention with an end weight detached from a wing of the boomerang.
Figure 3:
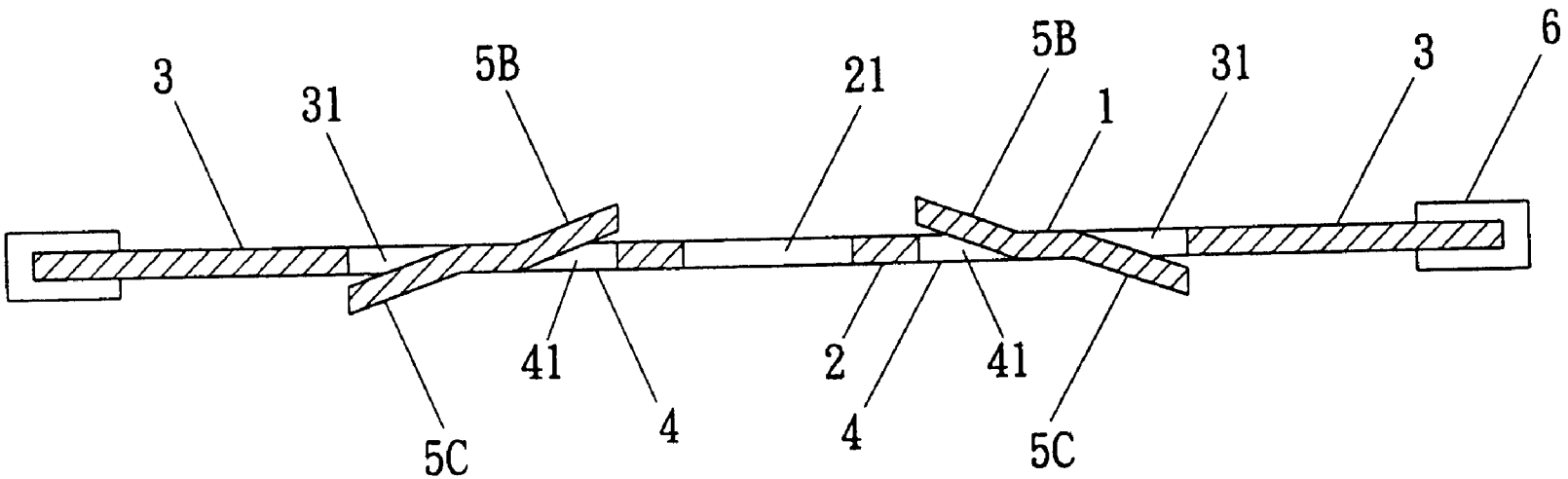
FIG. 3 is a cross-sectional view of the boomerang of the present invention.

With reference to the drawings and in particular to FIGS. 2 and 3, a boomerang constructed in accordance with the present invention comprises a central disk comprised of an inner ring 2 defining a central bore 21 and an outer ring 1 substantially concentric to and surrounding the inner ring 2. A plurality of connection sections 4 connects between the inner and outer rings 2, 1. Preferably, the connection sections 4 are extended in a radial direction of the central disk and are spaced at a fixed angular interval in a circumferential direction. Arc openings 11 are thus defined between the inner and outer rings 2, 1 and each delimited by adjacent connection sections 4. Both the central bore 21 and the arc openings 11 serve as passages for airflow therethrough when the boomerang is flying.

A plurality of wings 3 extends from an outer circumference of the outer ring 1 in radial directions. In other words, an axis of each wing 3 coincides with a radius of the central disk. The wings 3 are equally spaced in the circumferential direction of the central disk. Preferably, the number of the wing 3 is identical to that of the connection sections 4 and each wing 3 aligns with each connection section 4. However, it is apparent that the numbers of the wings 3 and the connection sections 4 are not necessary to agree with each other. In other words, there may be more or less wings 3 than the connection sections 4. The wings 3 are arranged symmetric about a center axis of the central disk to maintain force balance and thus stable flying. Although symmetric arrangement of the connection sections 4 also helps maintaining force balance and flying stability, it is not necessary to be so.

A plurality of floatation enhancing tabs 5A extends, preferably in a radial direction, from an inner circumference of the outer ring 1. The tabs 5A are arranged symmetric about a center axis of the central disk. This ensures balance of floating forces acting upon the tabs 5A. In the embodiment, one tab 5A is arranged between adjacent connection sections 4. In other words, each tab 5A extends from the inner circumference of the outer ring 1 into each arc opening 11 whereby airflow passing through the arc opening 11 during the flying of the boomerang provides buoyancy acting upon the tab 5A.

It is apparent to those having ordinary skills to arrange more than one tab 5A between the adjacent connection sections 4 or there may be no tab 5A in some of the arc opening 11.

The tabs 5A are inclined upwards with respect to the central disk to guide airflow through the associated arc opening 11. This enhances smooth and stable flying of the boomerang.

In each connection section 4, an opening 41 is formed for airflow therethrough during the flying of the boomerang. Arranged immediately close to the opening 41 is a connection section associated tab 5B, which extends from an edge of the opening 41 with a free end inclined upwards. The tab 5B can be identical to the tab 5A and preferably, the tabs 5A and 5B are spaced along the inner circumference of the outer ring 1 in an equally spaced manner.

In each wing 3, an opening 31 is defined for airflow therethrough during the flying of the boomerang. Arranged immediately close to the opening 31 is a wing associated tab 5C, which extends from an edge of the opening 31 in a direction opposite to the connection section associated tab 5B and a free end of the wing associated tab 5C inclines downwards. The wing associated tab 5C can be identical to the connection section associated tab 5B but extending and inclined in opposite directions. Both the tabs 5B, 5C help maintaining flying stability and smoothness, as well as enhancing floatation of the boomerang.

Preferably, the tabs 5B and 5C are aligned in an axis of the wing 3. Although the wing associated tab 5C can be formed at any position along the axis of the wing 3, it is preferred and as illustrated in the drawings that the wing associated tab 5C extends from an outer circumference of the outer ring 1 in a radial direction.

A weight block 6 is attached to an axial remote free end of each wing 3, which increases rotation inertia when the boomerang is thrown and in turn enhancing flying stability.

The boomerang can be made of any suitable material, such as a thin plastic board, and is formed by any known techniques, such as cutting or stamping, to form the shape thereof.

Figure 4:
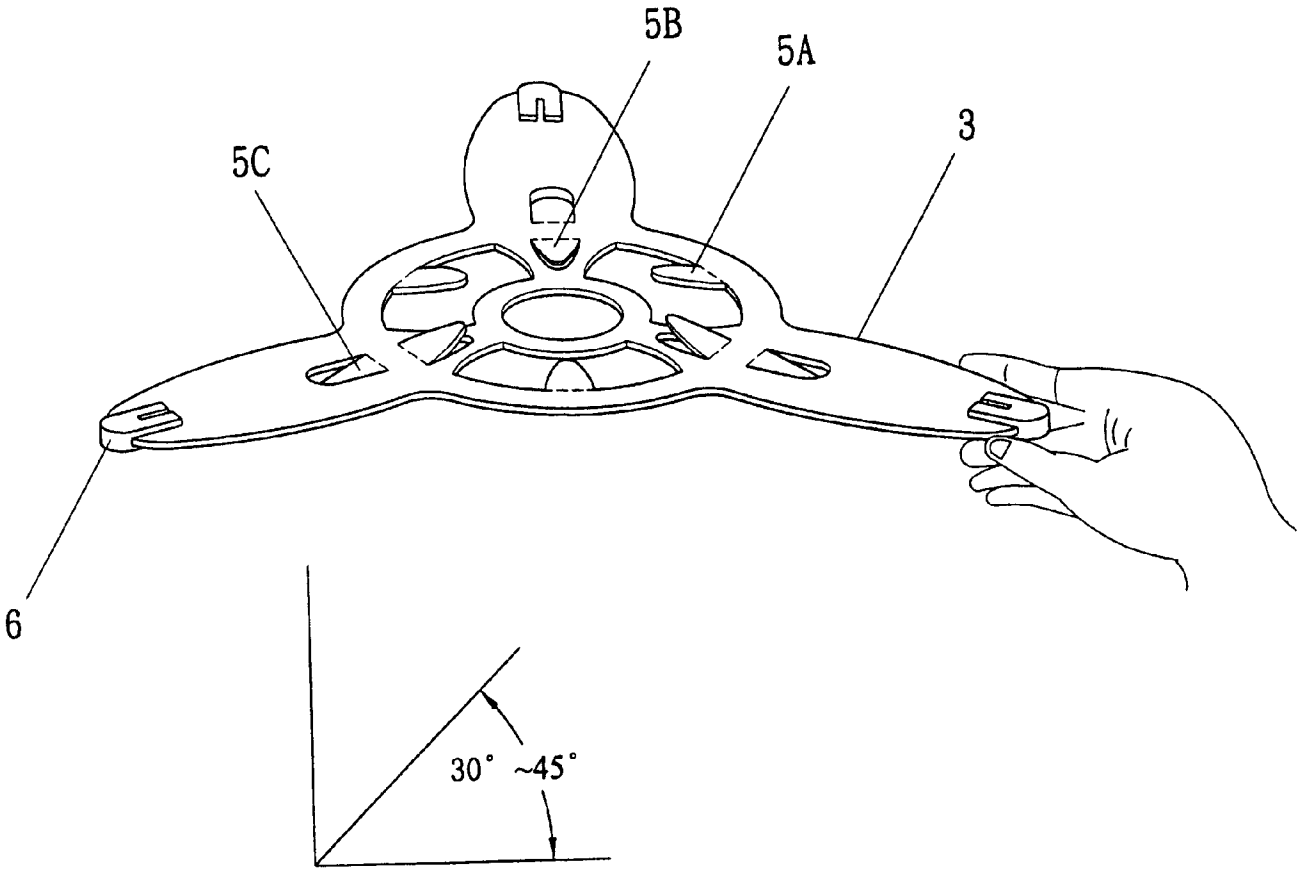
FIG. 4 is a perspective view illustrating the boomerang held by a player's hand before the boomerang is thrown out.
Figure 5:
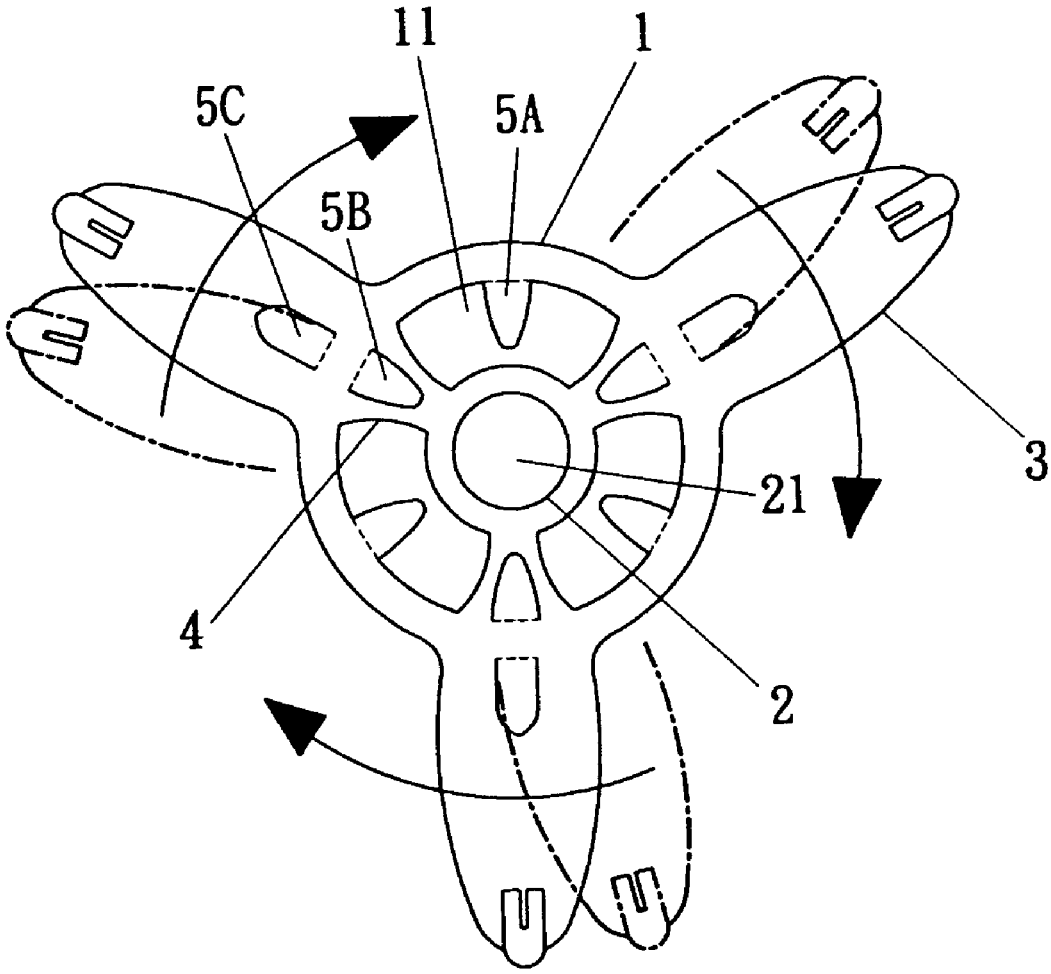
FIG. 5 is a top plain view illustrating the operation of the boomerang when flying in the air.
Figure 6:
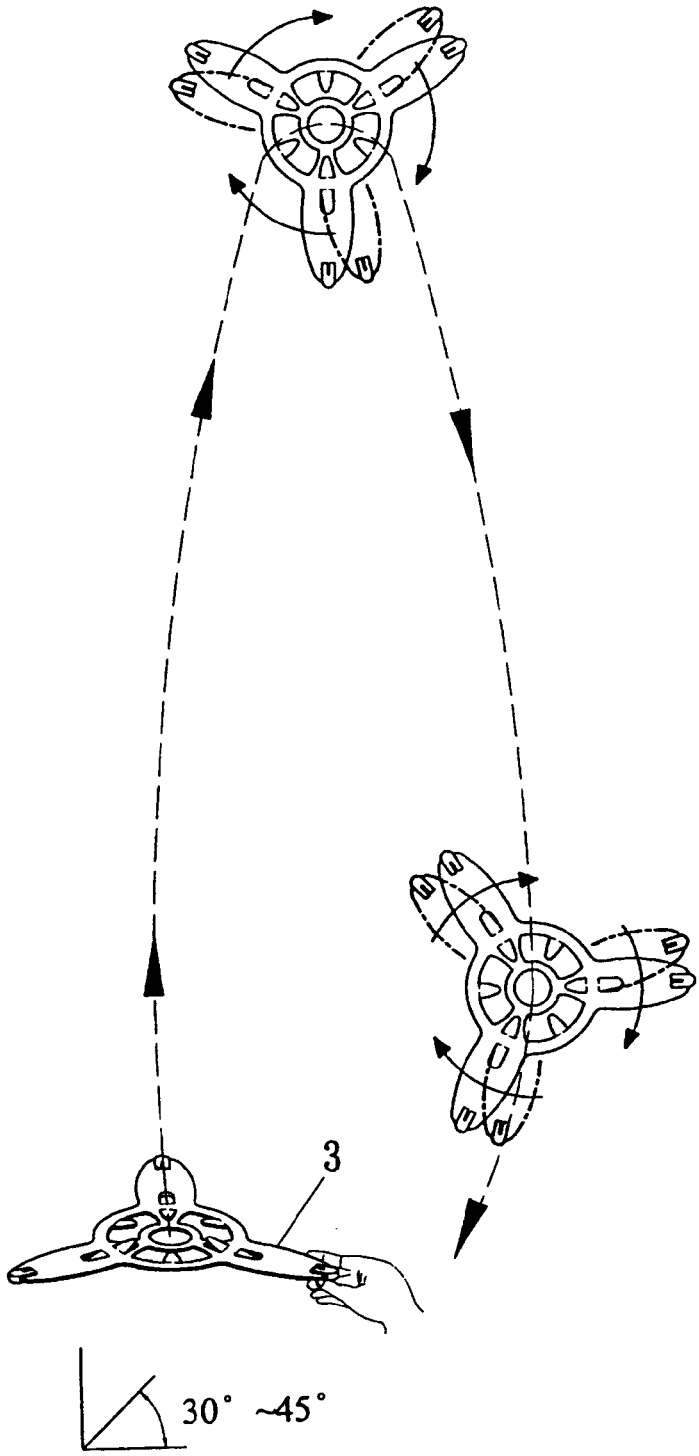
FIG. 6 is a schematic view illustrating a flying path of the boomerang in accordance with the present invention.

Also referring to FIGS. 4–6, to play the boomerang, a player holds the free end of one wing 3 by one hand with the central disk of the boomerang at an angle of around 30–45 degrees inclined with respect to the horizon. By throwing the boomerang at such an inclining angle, the boomerang rotates as indicated by arrows in FIG. 5 and moves forward as indicated by arrows of FIG. 6 to penetrate into the atmosphere, which induces floatation acting on the boomerang, making the boomerang ascending. During the forward movement, airflow passes through the central bore 21, the arc openings 11, as well as openings 31, 41 defined in the wings 3 and the connection sections 4, which helps providing a stable and balanced movement of the boomerang through the atmosphere and extending the time cycle when the boomerang maintains in the air.

When the boomerang reaches a highest or farthest point in the ascending path, the boomerang returns along a returning path in which the weight of the boomerang and the air pressure acting upon the boomerang make the boomerang descend, as indicated in FIG. 6.

The boomerang of the present invention features balanced and stable flotation induced by airflow passing through the central bore 21, the arc openings 11, and the openings 31, 41 defined in the wings 3 and the connection sections 4, which is subject to constraints imposed by the tabs 5A, 5B, 5C. Thus, a stable and extended flying of the boomerang can be realized. Undesired falling or fast descending of the boomerang caused by turbulences and blows or other factors occurring during the flying of the boomerang can be effectively eliminated.

Although the present invention has been described with reference to the preferred embodiment with reference to the drawings thereof, it is apparent to those skilled in the art that a variety of modifications and changes may be made without departing from the scope of the present invention which is intended to be defined by the appended claims.

What is claimed is:

1. A boomerang comprising:

a central disk; and a plurality of wings extending along radii of the central disk and each wing having a remote free end;

wherein a first opening is defined in each wing and a second opening is defined in the central disk substantially aligned with the first opening along a radius of the central disk, a first tab extending from an edge of the first opening, a second extending from an edge of the second opening in a direction opposite to the first tab, the first tab being inclined in a first direction away from the central disk and the second tab being inclined in a second direction away from the central disk, the second direction being opposite to the first direction.

2. The boomerang as claimed in claim 1, wherein the central disk comprises inner and outer rings concentric to each other and connected to each other by connection sections whereby arc openings are defined between the inner and outer rings and delimited by the connection sections with at least some connection sections aligning with the wings, the second opening being defined in each of said some connection sections.

3. The boomerang as claimed in claim 2, wherein a third tab extends from an inner circumference of the outer ring and inclined in a given direction.

4. The boomerang as claimed in claim 3, wherein the third tab is arranged in each arc opening between the inner and outer rings.

5. The boomerang as claimed in claim 1, wherein the central disk defines a central bore.

6. The boomerang as claimed in claim 5 further comprising a weight block attached to at least some of the wings.

7. The boomerang as claimed in claim 6, wherein the weight block is attached to the free end of each wing.

8. The boomerang as claimed in claim 2, wherein three wings extend from an outer circumference of the outer ring and are equally spaced along the outer circumference.

9. The boomerang as claimed in claim 8, wherein three connection sections connect the inner and outer rings together, each connection section aligning each wing.

10. The boomerang as claimed in claim 1, wherein the boomerang is formed by cutting a thin plastic board.

* * * * *